US006729285B2

(12) United States Patent
Ammon et al.

(10) Patent No.: US 6,729,285 B2
(45) Date of Patent: May 4, 2004

(54) LEVER-TYPE CAM FOLLOWER MADE OF SHEET METAL

(75) Inventors: Reinhard Ammon, Nuremberg (DE); Robert Kamm, Veitsbronn (DE); Wolfgang Mayer, Seukendorf (DE); Hubert Geus, Kemmern (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 10/419,668

(22) Filed: Apr. 21, 2003

(65) Prior Publication Data

US 2003/0196629 A1 Oct. 23, 2003

Related U.S. Application Data

(60) Provisional application No. 60/374,558, filed on Apr. 22, 2002.

(30) Foreign Application Priority Data

Apr. 23, 2002 (DE) ..... 102 18 026

(51) Int. Cl.[7] ..... F01L 1/18

(52) U.S. Cl. ..... 123/90.39; 123/90.41; 74/569

(58) Field of Search ..... 123/90.39, 90.4, 123/90.41, 90.44, 90.48; 74/559, 567, 569, 469, 471 R; 29/888.2

(56) References Cited

U.S. PATENT DOCUMENTS 5,819,694 A * 10/1998 Trutescu et al. ..... 123/90.43
6,601,555 B2 * 8/2003 Okubo et al. ..... 123/90.39
6,615,635 B2 * 9/2003 Ammon ..... 72/379.2

FOREIGN PATENT DOCUMENTS

JP 05272310 A * 10/1993 ..... F01L/1/18

* cited by examiner

*Primary Examiner*—Thomas Denion
*Assistant Examiner*—Ching Chang
(74) *Attorney, Agent, or Firm*—Muserlian, Lucas and Mercanti

(57) ABSTRACT

What is proposed is a lever-type cam follower (1) made of sheet metal, typically for a valve train of an internal combustion engine, said cam follower (1) comprising two parallel side walls (3*a*, 3*b*) connected by a crossbeam (2), an underside (4) of the crossbeam (2) having a support (6) for at least one gas exchange valve on one end (5), said support (6) being limited by guide walls (7*a*, 7*b*) extending parallel to the side walls (3*a*, 3*b*), wherein the one end (5) of the cam follower (1) is narrower than the rest of the length of the cam follower (1), and at least in the region of said one end (5), the side walls (3*a*, 3*b*) have a smaller mean wall thickness ($D_{SM}$) than over the rest of said length, which wall thickness ($D_{SM}$) increases at least in said region continuously from ends (8*a*, 8*b*) of the side walls (3*a*, 3*b*) in the direction of the crossbeam (2), and the thickness ($D_F$) of the guide walls (7*a* 7*b*) is smaller than the mean wall thickness ($D_{SM}$) in the region of the narrow one end (5). Such a cam follower (1) requires only a small design space in the region of the one end (5) and has a particularly favorable mass moment of inertia.

8 Claims, 1 Drawing Sheet

LEVER-TYPE CAM FOLLOWER MADE OF SHEET METAL

This application claims the benefit of Provisional Application No. 60/374,558, filed Apr. 22, 2002.

DESCRIPTION

1. Field of the Invention

The invention concerns a lever-type cam follower made of sheet metal, typically for a valve train of an internal combustion engine, said cam follower comprising two parallel side walls connected by a crossbeam, an underside of the crossbeam having a support for at least one gas exchange valve on one end, said support being limited by guide walls extending parallel to the side walls.

2. Field of the Invention

A generic cam follower of the pre-cited type is known from DE 100 30 341 A1. This cam follower is likewise made of sheet metal and is optimized with regard to its width and weight in the region of its valve stem support. However, despite all the measures proposed in this document, problems of design space can still be encountered during the installation of such a cam follower in the internal combustion engine. It is to be remarked further that, due to the undesired, still too large accumulation of mass at a distance from the fulcrum, the mass moment of inertia of the cam follower is also too high.

Particularly in the case of four-valve or five-valve structures, alone, or in conjunction with very compact cylinder spacing, it is clear to a specialist in the field of engine construction that a further optimization of the cam follower at least in the region of the valve shaft support is necessary in order to solve existing design space problems.

OBJECTS OF THE INVENTION

It is an object of the invention to provide a cam follower of the pre-cited type in which the mentioned drawbacks are eliminated by simple measures.

This and other objects and advantages of the invention will become obvious from the following detailed description.

SUMMARY OF THE INVENTION

The invention achieves the above objects by the fact that the one end of the cam follower is narrower than a rest of a length of the cam follower, and at least in a region of said one end, the side walls have a smaller mean wall thickness than over the rest of said length, which wall thickness increases at least in said region continuously from ends of the side walls in direction of the crossbeam. A thickness of the guide walls may be smaller than, or substantially equal to the mean wall thickness in said region of said one end.

The cam follower thus obtained is therefore further optimized with regard to its design space requirement. In the final analysis, the minimum width of the cam follower in the region of the valve stem support is determined by the thickness of the valve stem and the thickness of the adjoining guide walls of the cam follower on both sides, or, in other words, by the distance between the outer surfaces of the side walls in this region.

Due to the narrow configuration of the cam follower at the one end, in conjunction with the fact that, to put it simply, the guide walls are thinner than the side walls, the mass moment of inertia of the cam follower is further reduced and its design space requirement, at least in the region of the valve stem support, is distinctly smaller than in prior art cam followers. At the same time, the cam follower has a particularly rigid configuration, and if the region of its valve stem support is made by a stamping and extrusion molding method, it also possesses an excellent strength in this region. Further, due to the continuously increasing thickness of the side walls, at least in the region of the one narrow end, creases in the transition region to the crossbeam are effectively prevented.

It is clear that, depending on each particular case of use, a person skilled in the art will vary the height of the guide walls so as to prevent a slipping-off of the cam follower during assembly and during the start-up phase of the internal combustion engine.

The valve stem support is advantageously made by the aforesaid stamping and extrusion molding method i.e., by cold forging, in the same or similar manner as described in the initially cited document DE 100 30 341 A1. For "thinning-out" the guide walls, material from their outer surfaces is also used. This is done after the side walls have been bent and, if necessary, with the use of a partially thickened blank. The sheet metal cam follower, as such, can be made out of strip or solid material. The most preferred material is sheet steel but it is also conceivable to use other sheet metals with which a person skilled in the art is familiar.

According to a further embodiment of the invention, the narrow one end of the cam follower is formed out of a gradually tapering portion of the cam follower. From the fabrication point of view, this embodiment is simple to realize and prevents cracking in the transition region. However, it is also possible to make the narrow end as a stepped shoulder.

According to a further advantageous feature of the invention, the narrow one end ends in a longitudinal portion of uniform width so that the guide walls extend parallel to the outer surfaces of the side walls. This is advantageous from the fabrication point of view. However, it is also possible to let the narrow one end taper to a point. A person skilled in the art will use appropriate calculation methods to optimize the length of the narrow portion of the cam follower and make the guide walls, and the side walls in the region of the guide walls, as narrow as possible till an optimum light-weight structure is obtained in this region which, at the same time, possesses adequate rigidity etc.

According to a particularly important feature of the invention, the guide walls are made integrally with the underside of the crossbeam and extend away from this, and further, the outer surfaces of the guide walls are clearly offset inward from the outer surfaces of the side walls in the region of the one end. It is therefore clear that the guide walls are made out of the material of the bottom and also quite obvious that they are not to be considered as extensions of the side walls. As already elucidated above, this is advantageous from the fabrication and design space point of view.

Alternatively, however, the guide walls may also be made as separate components that, at least, originally do not start from the underside of the crossbeam. If the guide walls are made as separate elements, they can be fixed on the underside by appropriate fixing methods such as welding, gluing or positive retention.

The proposed cam follower is preferably made of a light-weight material such as sheet metal but it is also conceivable to make a cam follower having the design of the invention by creative forming or casting.

The invention will now be described more closely with reference to the appended drawings.

DETAILED DESCRIPTION OF THE DRAWINGS

Figure 1:
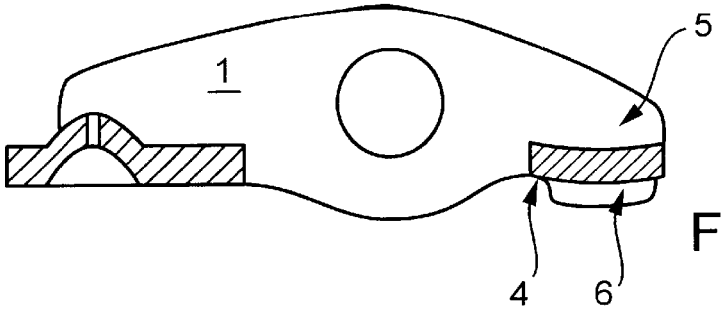
FIG. 1 shows a longitudinal section through a cam follower of the invention.

The figures show a cam follower 1 of a valve train of an internal combustion engine, which cam follower 1 is made of sheet metal and configured as a finger lever. The cam follower 1 has two parallel side walls 3*a*, 3*b* that are connected by a crossbeam 2. As viewed in a cross-section, the cam follower 1 has an upwardly open U-profile. An underside 4 of the cam follower 1 comprises a support 6 for a gas exchange valve on one end 5. The support 6 is limited on both sides by guide walls 7*a*, 7*b*.

Figure 2A:
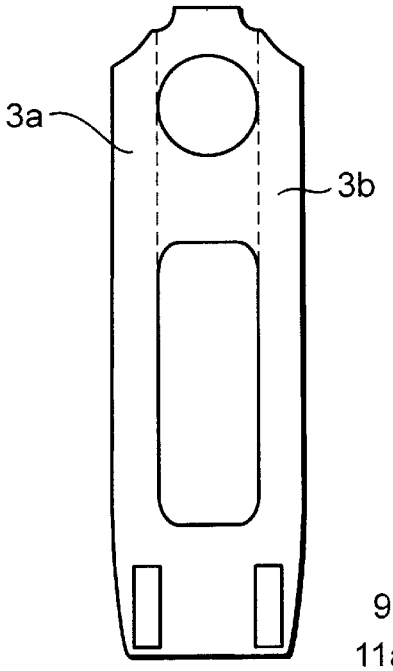
FIGS. 2*a* to 2*c* show bottom views of the cam follower with differently configured ends.
Figure 2B:
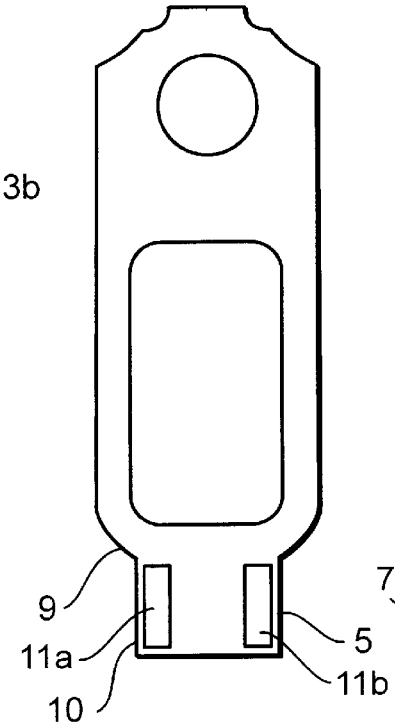
Figure 2C:
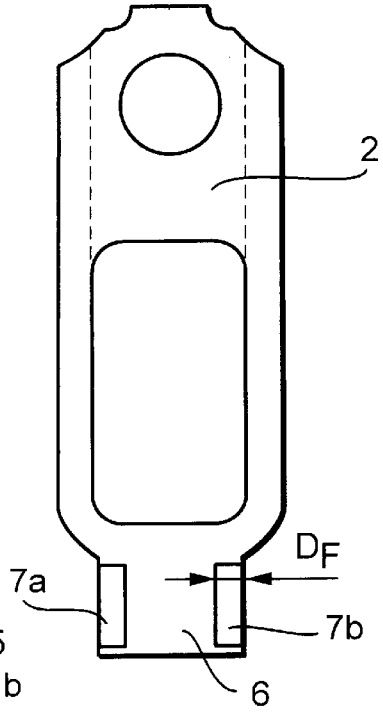

FIG. 2*b* discloses that the side walls 3*a*, 3*b* merge into a gradually tapering portion 9 in the direction of the one end 5. As also shown in FIG. 2*c*, this portion 9 continues into a longitudinal portion 10 of uniform width. Thus, the end 5 is clearly narrower than the rest of the cam follower 1.

The guide walls 7*a*, 7*b* are arranged on the one end 5 in the region of the longitudinal portion 10. As disclosed in FIG. 2*b*, the guide walls 7*a*, 7*b* are offset inwards from the side walls 3*a*, 3*b* and have a smaller thickness $D_F$ than the side walls 3*a*, 3*b*. It is particularly advantageous if this thickness $D_F$ is smaller than a mean wall thickness $D_{SM}$ of the side walls 3*a*, 3*b* in the region of the narrow one end 5.

FIGS. 2*a*, 2*b* show guide walls 7*a*, 7*b* that are offset inward from the side walls 3*a*, 3*b*, whereas FIG. 2*c* discloses guide walls 7*a*, 7*b* whose outer surfaces 11*a*, 11*b* prolong the outer surfaces 12*a*, 12*b* of the side walls 3*a* 3*b*.

Figure 3A:
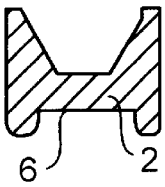
FIGS. 3*a*, 3*b* show cross-sections through the cam follower in the region of its valve stem support.
Figure 3B:
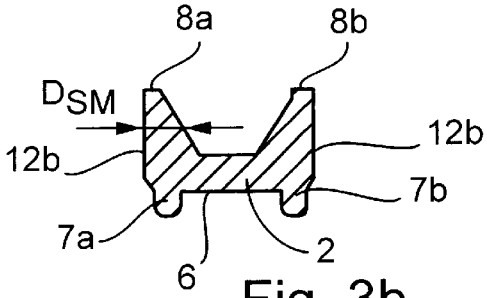

It is emphasized at this point that the most advantageous embodiment of the invention is obtained by combining the features of FIG. 2*b* with those shown in FIG. 3*b*.

A person skilled in the art can see from FIGS. 3*a*, 3*b* that, starting from the ends 8*a*, 8*b*, the wall thickness $D_{SM}$ of the side walls 3*a*, 3*b* increases continuously in the direction of the crossbeam 2. With the aim of realizing this design, the end 5 of the cam follower 1 is fabricated particularly advantageously by a stamping and extrusion molding method (cold forging) and is endowed with an excellent rigidity while at the same time possessing a very small mass and a minimum mass moment of inertia.

As already mentioned above, FIG. 3*b* discloses that the guide walls 7*a*, 7*b* are clearly offset inward from the side walls 3*a*, 3*b*, so that, at least in the region of the underside 4, an extremely small design space is required.

The cam follower 1 illustrated in the drawings is a finger lever. However, the invention applies equally to cam followers configured as rocker arms or oscillating arms. Further, the U-shaped cross-sectional profile of the cam follower 1 disclosed in the drawings is not essential to the invention but, rather, the cross-section of the cam follower may also have an H-shaped or similar profile, or a profile that is only similar to a U-shape.

What is claimed is:

1. A lever-type cam follower made of sheet metal, for a valve train of an internal combustion engine, said cam follower comprising two parallel side walls connected by a crossbeam, an underside of the crossbeam having a support for at least one gas exchange valve on one end, said support being limited by guide walls extending parallel to the side walls, wherein the one end of the cam follower is narrowed with respect to the cam follower, and at least in a region of said one end, the side walls have a smaller mean wall thickness ($D_{SM}$) than over the rest of the said cam-follower, which the said mean wall thickness ($D_{SM}$) increases at least in said region continuously from ends of the side walls in direction of the crossbeam.

2. A cam follower of claim 1, wherein a thickness ($D_F$) of the guide walls is smaller than the mean wall thickness ($D_{SM}$) in the region of the narrow one end.

3. A cam follower of claim 1, wherein a thickness ($D_F$) of the guide walls corresponds substantially to the mean wall thickness ($D_{SM}$) in the region of the narrow one end.

4. A cam follower of claim 1, wherein the narrow one end starts from a gradually tapering portion of the cam follower.

5. A cam follower of claim 1, wherein the narrow one end ends in a longitudinal portion of uniform width.

6. A cam follower of claim 5, wherein the guide walls extend at least substantially in the longitudinal portion.

7. A cam follower of claim 1, wherein the guide walls are integrally connected to the underside of the crossbeam and extend away from the underside, outer surfaces of the guide walls being clearly offset inward from outer surfaces of the side walls in the region of the one end.

8. A cam follower of claim 7, wherein at least the guide walls on the one end are made by a stamping and extrusion molding method, and, prior to substantial forming of the guide walls, the side walls are bent at a right angle to the crossbeam.

* * * * *